US006068509A

United States Patent [19]

Lin

[11] Patent Number: 6,068,509

[45] Date of Patent: May 30, 2000

[54] STACKING TYPE CONNECTOR

[75] Inventor: Ming Ching Lin, Taipei Hsien, Taiwan

[73] Assignee: C.S. Conser Enterprise Co., Ltd., Taipei Hsien, Taiwan

[21] Appl. No.: 09/238,018

[22] Filed: Jan. 26, 1999

[51] Int. Cl.[7] ..... H01R 13/66

[52] U.S. Cl. ..... 439/541.5; 439/540.1

[58] Field of Search ..... 439/62, 64, 79, 439/80, 540.1, 567, 701, 541.5

[56] References Cited

U.S. PATENT DOCUMENTS

| | | | |
|---|---|---|---|
| 4,878,856 | 11/1989 | Maxwell | 439/540 |
| 5,167,531 | 12/1992 | Broschard et al. | 439/540 |
| 5,688,130 | 11/1997 | Huang | 439/79 |
| 5,800,207 | 9/1998 | Hsu et al. | 439/541.5 |
| 5,823,822 | 10/1998 | Tan et al. | 439/541.5 |

*Primary Examiner*—Lincoln Donovan
*Assistant Examiner*—Chandrika Prasad
*Attorney, Agent, or Firm*—Rosenberg, Klein & Lee

[57] ABSTRACT

A stacking-type connector comprising mounting plate, a first connector on an upper groove of the mounting plate, a second connector on a lower groove of the mounting plate, a stage comprising a plurality of guiding holes, by penetrating the conductive terminals of the first connector and the second connector through the guiding holes, the stage can be positioned between the first connector and the second connector. The stage placed between the first connector and the second connector has structure concentrating on the central portion of the first guiding hole such that free space can be released on both sides thereof. Moreover, two shoulder plates extends backward from the both sides of the insulating base of the second connector and the length thereof does not exceed the depth of the second connector. Therefore, the space on both sides of the stage can be fully released such that the utilization of circuit board area can be enhanced and the manufacture cost can be reduced with reduced materials.

1 Claim, 3 Drawing Sheets

PIROR ART

STACKING TYPE CONNECTOR

FIELD OF THE INVENTION

The present invention relates to an improved connector, more particularly, to a stacking-type connector comprising a first D connector on upper layer and a second D connector on lower layer.

BACKGROUND OF THE INVENTION

As shown in FIG. 1, a conventional stacking-type connector 1 comprises an upper groove 100 and a lower groove 101 arranged on a metal mounting plate 10, a first connector 11 and a second connector 12 arranged by rivet within the grooves 100 and 101, respectively, and conductive terminal 110 arranged within the first connector 11. A T-shaped stage 13 (L-shape from lateral view) is arranged below the first connector 11. To assemble the stage 13, the stage 13 is pushed upward such that the conductive terminals 110 of the first connector 11 insert into the first guiding hole (not shown) of the stage 13. Moreover, the bottom plate extending forward from the bottom side of the stage 13 has second guiding hole (not shown) through which the corresponding terminal of the second connector 12 penetrates. The locking block 131 arranged on the lateral side of the bumps 130 on both side of the stage 13 is locked upon the shoulder plate 102 extending backward from both side of the mounting plate 10, thus fixing the mounting plate 10. Moreover, a round hole 103 is provide on the front and backside of each shoulder plate 102 of the mounting plate 10 for the placement of a fixing pin 104 by which the connector 1 can be fixed on the circuit board. The fixing pin 104 is in the shape of symmetry "+++" which has pin 105 on both ends thereof and projecting vertically from the round hole 103, and central clamping plates 105 clamping the spacer between two adjacent round holes 103.

From above description, it is known that the pin number (9 pins) of the conductive terminal 110 of the first connector 11 is far less than the pin number (25 pins) of the conductive terminal of the second connector 12, and the pins of the both terminals concentrate on the central location with the first guiding hole. Therefore, the stage 13 has only guiding ability for the conductive terminal 110 provided by the central guiding hole portion, and the bumps 130 on both sides thereof do not provide the guiding function. Therefore, the bumps has not provide extra function and increases the occupied area, the cost of the stage 13 is increased and the utilization for space is degraded.

On the other hand, the mounting plate 10 has two shoulder plates 102 with same length as the depth of the stage 13 such that the locking block 131 can be locked thereon. However, the arrangement of the shoulder plate 102 also occupies considerable space and the assembling of the fixing pin 104 becomes tedious and less stable.

It is an object of the present invention to provide an improved stacking-type connector wherein the stage placed between the first connector and the second connector has structure concentrating on the central portion with guiding hole such that free space can be released on both sides thereof Moreover, two shoulder plates extends backward from the both sides of the insulating base of the second connector and the length thereof does not exceed the depth of the second connector. Therefore, the space on both sides of the stage can be fully released such that the utilization of circuit board area can be enhanced and the manufacture cost can be reduced with reduced materials.

It is another object of the present invention to provide an improved stacking-type connector, wherein the two fixing pins for fixing the stacking-type connector to the circuit board is clamped between the mounting plate and the second connector and then riveted together with the mounting plate and the second connector. The various objects and advantages of the present invention will be more readily understood from the following detailed description when read in conjunction with the appended drawing, in which:

DETAILED DESCRIPTION OF PREFERRED EMBODIMENTS

Figure 1:
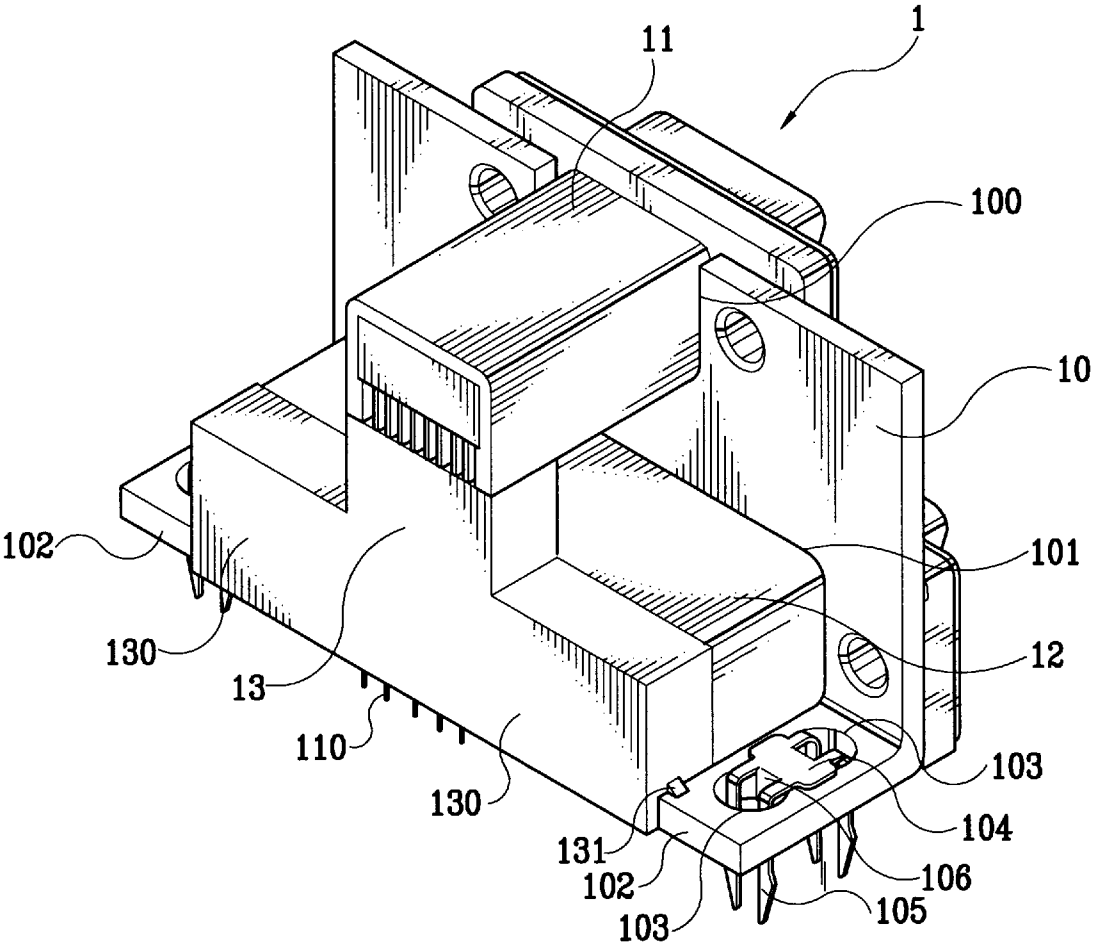
FIG. 1 shows the rear side view of a conventional stacking-type connector.
Figure 2:
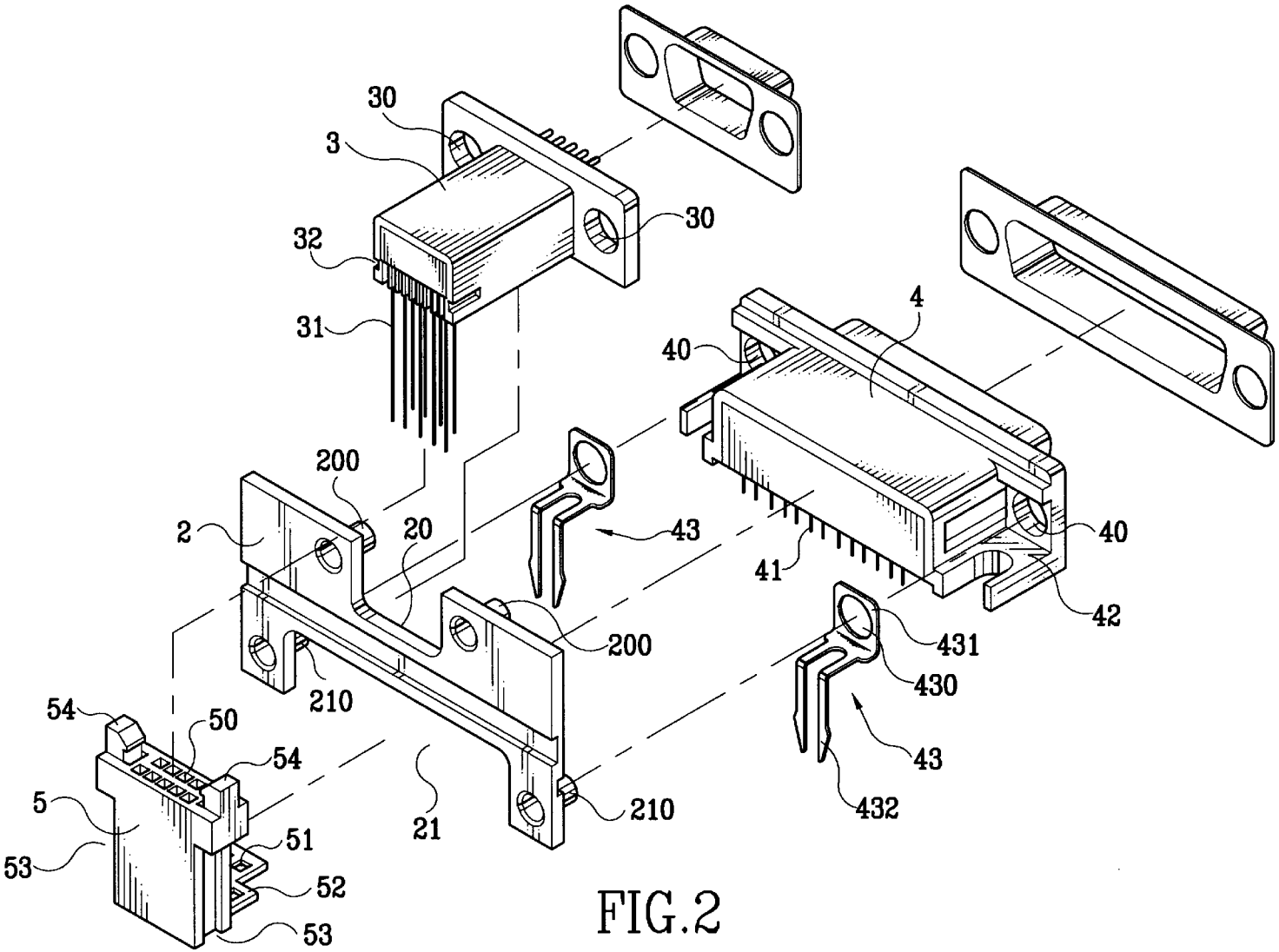
FIG. 2 shows the exploded view of the inventive connector.
Figure 3:
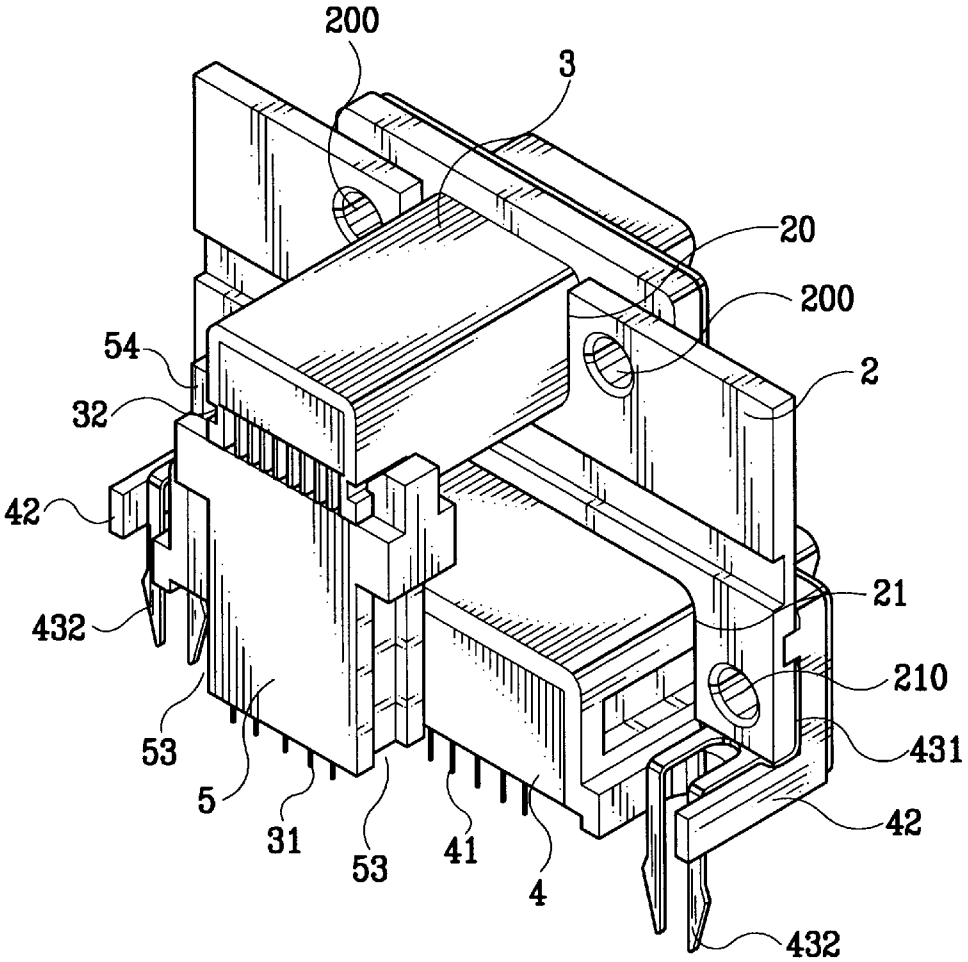
FIG. 3 shows the rear side view of the inventive connector.

As shown in FIGS. 2 and 3, the inventive stacking-type connector comprises a metal mounting plate 2, a first connector 3 and a second connector 4. The mounting plate 2 has an upper groove 20 for the arrangement of the first connector 3, and a lower groove 21 for the arrangement of the second connector 4, respectively. A plurality of riveting pipes 200, 210 are arranged on the mounting plate 2 and beside the grooves 20 and 21. The riveting pipes 200, 210 can be inserted into the first and second riveting holes 30 and 40 on the first connector 3 and the second connector 4, respectively such that those connectors 3 and 4 can be joined with the mounting plate 2.

Moreover, a stage 5 comprising a plurality of first guiding holes 50, second guiding holes 51 and a base plate 52 is provided below the first connector 3. By penetrating the conductive terminals 31 and 41 of the first connector 3 and the second connector 4 through the first guiding hole 50 and the second guiding hole 51, the stage 5 can be positioned between the first connector 3 and the second connector 4. It should be noted that the structure of the stage 5 is concentrated on the central portion with the first guiding hole 50 and open spaces 53 are left on both sides of the stage 5. The stage 5 has two locking blocks 54 formed on the top lateral side thereof, and the first connector 3 has two locking grooves 32 formed on the positions corresponding to those of the locking blocks 54 such that the locking blocks 54 can be engaged into the locking grooves 32.

The second connector 4 has two shoulder plates 42 extending backward from the two lateral sides of the insulating case thereof. The length of the shoulder plate 42 is such that the shoulder 42 does not expose out of the rear surface of the insulating case of the second connector 4. The second connector 4 further comprises a fixing leg 43 formed by repeatedly bending a metal plate and having riveting plate 431 with a third riveting hole 430 and L-shaped pin 432. Before the join operation of the mounting plate 2 and the second connector 4, the flexing leg 43 is sandwiched between the mounting plate 2 and the second connector 4 by inserting the riveting pipe 210 into the third riveting hole 432. Therefore, the fixing leg 43 can be joined together with the mounting plate 2 and the second connector 4, as shown in FIG. 3.

From above description, the stage 5 in the invention is locked upon the first connector 3 rather than locked on a shoulder plate extending from the mounting plate. Therefore, bumps occupying considerable space are not required to provide on the both side of the stage 5. Free spaces 53 on both side of the stage 5 are released. The length of the shoulder plates 42 on the insulating case of the second connector 4 are not required to reach both side of the stage. The portion of the circuit board below the space 53 has better utilization and the materials used of the stage 5 and the mounting plate 2 can be reduced.

Moreover, the fixing leg 43 used to clamp the connector onto the circuit board is sandwiched between the second connector 4 and the mounting plate 2, and then riveted together. The assembling operation of the fixing leg 43 is simplified and the stacking-type connector can be more firmly clamped on circuit board.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A stacking-type connector comprising:

a mounting plate having an upper groove and a lower groove, said mounting plate including a plurality of riveting pipes formed thereon adjacent said upper and lower grooves;

a first connector extending through said upper groove of said mounting plate and having riveting holes for insert and coupling to a respective portion of said plurality of riveting pipes, said first connector having a first housing of a first width dimension and a first predetermined number of terminals, said first housing having a pair of locking grooves formed adjacent a rear end thereof;

a second connector extending through said lower groove of said mounting plate and having riveting holes for insert and coupling to a remaining portion of said plurality of riveting pipes, said second connector having a second housing of a second width dimension and a second predetermined number of terminals, said second width dimension being greater than said first width dimension and said second predetermined number of terminals being greater than said first predetermined number of terminals; and, a stage having a longitudinally extended body portion of a third width dimension and a base plate extending transversely from said body portion, said body portion of said stage being disposed adjacent a rear end portion of said second connector and having a plurality of first guiding holes formed therethrough for passage of said first predetermined number of terminals therethrough, said base plate having a plurality of second holes formed therethrough for passage of a portion of said second predetermined number of terminals therethrough, said body portion of said stage having two locking blocks respectively formed on opposing top lateral sides thereof for coupling said stage to said first connector, said locking blocks being engaged with said locking grooves of said first connector, said second connector having two shoulder plates respectively extending rearwardly on two lateral sides of said second housing, each said shoulder plate having a distal end thereof coincident with said rear end portion of said second connector to define open spaces on opposing lateral sides of said body portion of said stage.

* * * * *